US009541082B2

(12) United States Patent
Hiraide et al.

(10) Patent No.: US 9,541,082 B2
(45) Date of Patent: Jan. 10, 2017

(54) OIL-WELL-PUMP DRIVING HYDRAULIC SYSTEM

(71) Applicant: YUKEN KOGYO CO., LTD., Ayase-shi, Kanagawa (JP)

(72) Inventors: Hirokazu Hiraide, Kanagawa (JP); Akihiro Hayashi, Kanagawa (JP)

(73) Assignee: YUKEN KOGYO CO., LTD., Kanagawa (JP)

( * ) Notice: Subject to any disclaimer, the term of this patent is extended or adjusted under 35 U.S.C. 154(b) by 346 days.

(21) Appl. No.: 14/346,248

(22) PCT Filed: Mar. 14, 2013

(86) PCT No.: PCT/JP2013/057166

§ 371 (c)(1),
(2) Date: Mar. 20, 2014

(87) PCT Pub. No.: WO2014/141426

PCT Pub. Date: Sep. 18, 2014

(65) Prior Publication Data

US 2015/0240800 A1 Aug. 27, 2015

(51) Int. Cl.
*F04B 49/00* (2006.01)
*F04B 49/06* (2006.01)
(Continued)

(52) U.S. Cl.
CPC ..... *F04B 49/06* (2013.01); *E21B 43/127* (2013.01); *F04B 47/02* (2013.01); *F04B 47/04* (2013.01);
(Continued)

(58) Field of Classification Search
CPC ..... F04B 49/08; F04B 49/03; F04B 49/22; F04B 49/002; F15B 2211/20553; F15B 11/0423
(Continued)

(56) References Cited

U.S. PATENT DOCUMENTS 4,530,645 A 7/1985 Whatley et al.
4,801,427 A 1/1989 Jacob
(Continued)

FOREIGN PATENT DOCUMENTS

JP 56-48494 A 5/1981
JP 60245805 A 12/1985
(Continued)

OTHER PUBLICATIONS

International Search Report (ISR) dated Jun. 18, 2013 issued in International Application No. PCT/JP2013/057166.
(Continued)

*Primary Examiner* — Michael Leslie
*Assistant Examiner* — Michael Quandt
(74) *Attorney, Agent, or Firm* — Holtz, Holtz & Volek PC

(57) ABSTRACT

In an oil-well-pump driving hydraulic system capable of avoiding occurrence of cavitation, at least a bidirectional variable displacement piston pump, a discharge rate detection portion, a discharge pressure detection portion, and a proportional solenoid control valve are contained as a single unit structure in a same housing as a pump body. The pump body includes: a connection portion provided on a side surface of the housing and to which a pump discharge passage of an external pilot hydraulic circuit is connected; and a second pilot passage that introduces an external pilot pressure from the connection portion to a pilot passage between the discharge passage of the piston pump and the proportional solenoid control valve.

2 Claims, 7 Drawing Sheets

(51) Int. Cl.

| | |
|---|---|
| ***F04B 47/02*** | (2006.01) |
| ***F04B 49/10*** | (2006.01) |
| ***E21B 43/12*** | (2006.01) |
| ***F15B 11/042*** | (2006.01) |
| ***F04B 47/04*** | (2006.01) |
| ***F04B 49/22*** | (2006.01) |
| *F04B 49/03* | (2006.01) |
| *F04B 49/08* | (2006.01) |

(52) U.S. Cl.
CPC ..... *F04B 49/106* (2013.01); *F04B 49/22* (2013.01); *F15B 11/0423* (2013.01); *F04B 49/002* (2013.01); *F04B 49/03* (2013.01); *F04B 49/08* (2013.01); *F15B 2211/20553* (2013.01)

(58) Field of Classification Search
USPC ..... 60/447, 452
See application file for complete search history.

(56) References Cited

U.S. PATENT DOCUMENTS

| | | | |
|---|---|---|---|
| 5,775,881 | A | 7/1998 | Stich |
| 2009/0321084 | A1 | 12/2009 | Simmons |

FOREIGN PATENT DOCUMENTS

| | | | |
|---|---|---|---|
| JP | 62270803 | A | 11/1987 |
| JP | 03124981 | A | 5/1991 |
| JP | 07056266 | B2 | 6/1995 |
| JP | 8-232853 | A | 9/1996 |
| JP | 08-261158 | A | 10/1996 |
| JP | 11-241687 | A | 9/1999 |
| JP | 2011-526972 | A | 10/2011 |

OTHER PUBLICATIONS

Chinese Office Action (and English translation thereof) dated Aug. 25, 2015, issued in counterpart Chinese Application No. 201380002838.8.

OIL-WELL-PUMP DRIVING HYDRAULIC SYSTEM

FIELD OF THE INVENTION

The present invention relates to a hydraulic system in which a bidirectional proportional solenoid piston pump for driving an oil well pump is structured using an external pilot method.

BACKGROUND OF THE INVENTION

When reservoir pressure is low in oil wells and crude oil does not flow, it is pumped for oil production. The sucker rod pump having a simple structure as shown in FIG. 8 has been used widely for many years particularly as an oil production pump method on land. This is driven by transmitting reciprocation of a reciprocating apparatus placed on the ground to the pump plunger connected to the head of a sucker rod R at the pipe bottom via this rod R.

Also in such an old pump method, for example by improving the control system of the pump jack, high speed operation is made possible to achieve high efficiency (for example, see Patent Document 1). However, in recent years, in renewal of oil well pump systems due to obsolescence, transitions to more efficient methods are advancing instead of use of such heavy mechanical pumps themselves.

From among them, as shown in FIG. 3, a method of pumping crude oil directly with a hydraulic cylinder 100 driven by hydraulic fluid from a hydraulic system 200 is mentioned. As this hydraulic system, one using a proportional solenoid piston pump that carries out direct driving by swash plate control has been developed. The proportional solenoid piston pump is a variable displacement piston pump that introduces an autogenous pressure of part of a pump discharge pressure to an operation piston as a pilot control pressure via a proportional solenoid control valve. Then, this operation piston pushes a swash plate whose tilt angle is correspondent to a discharge flow rate against a spring to control the tilt angle. In the proportional solenoid control valve, by a mechanical output generated in proportion to an excitation current as an output current responsive to a previously applied input signal, a solenoid plunger is variably displaced to control the pressure fluid acting on the operation piston. Then, via the control of the swash plate angle of the piston pump, the pressure and flow rate of the pump are controlled.

For example, as shown in the hydraulic circuit view of FIG. 4, when the flow rate and pressure are controlled via a proportional solenoid control valve 7 in proportion to an input signal (voltage or current) via a control amplifier 12, load pressure and the tilt angle of the swash plate that are correspondent to the flow rate are electrically fed back to the piston pump on the basis of detection signals from a pressure sensor 11 and a displacement rate detector 10 for variable elements. The control valve and each sensor can be structured easily as a pump body of a unit structure that mounts the piston pump 3 and its drive control system in the same housing.

In such an autogenous pressure control piston pump, when the discharge pressure becomes a pump minimum regulation pressure or below, it becomes difficult to ensure a pilot pressure for the operation piston to push the swash plate. Therefore, to ensure a control force at a low load, an external pilot method that introduces the discharge pressure of a fixed displacement pump 31 to the proportional solenoid control valve 7 as the pilot pressure force is used in many cases, as shown in the hydraulic circuit view of FIG. 5. In this case, a connection portion to an external pilot hydraulic circuit is provided on the housing of the pump body, and a pilot passage that communicates from the connection portion to a main hydraulic circuit is formed in the housing.

PRIOR ART DOCUMENTS

Patent Documents

[Patent Document 1]
JP-A No. 11-241687

SUMMARY OF THE INVENTION

Problems to be Solved by the Invention

However, in a conventional external pilot type proportional solenoid piston pump for driving an oil well pump, when the controller stops for a certain reason, the swash plate is pushed on the reverse side at the maximum angle and fixed on the hydraulic circuit, and accordingly the pump continues drawing in fluid. In this state, cavitation in which the gas dissolved in the hydraulic fluid forms bubbles within the pump under low pressure at suction and the bubbles are ruptured and lost due to the transition to a local high pressure state at discharge occurs in some cases. By continuously receiving its destruction force, the pump components may be damaged. However, in consideration of the environments where the systems are installed, such as vast oil fields far away from cities, it is assumed that the damaged state is left for several months, and therefore it is difficult to avoid the failure of the pump body.

As a measure for that, as shown in an oil pressure circuit of FIG. 6 and a schematic cross section view of FIG. 7, an external hydraulic circuit 40 in which a suction pipe 42 is provided to the discharge pipe via a prefill valve 41 separately can be considered. In this case, when the circuit pressure in the pump body decreases, the prefill valve 41 is opened by external pilot pressure, and immediately pressure fluid flows into the circuit in the pump body. Thus, the occurrence of cavitation can be avoided.

However, in such a structure, the suction piping 42 of the external hydraulic circuit 40 needs an equal piping size to that of the suction pipe of the pump to minimize pressure loss. Additionally, the prefill valve 41 having a large size is selected. The system piping is not only complicated but also large sized and increased in cost. It is difficult to say that this is an effective measure. Particularly, the equipment to prevent the occurrence of cavitation, including the prefill valve 41 and suction pipe 42, is not needed as long as the pump body is operating normally. The cost effectiveness is low. Therefore, the structure of the equipment is not practical for driving oil well pumps.

On the other hand, electrical measures such as installation of sensors can be easily considered, but in consideration of engine driving for ensuring power supply and all weather conditions, the possibility that the sensors themselves fail and the system stops is added. Therefore, the electrical measures are unacceptable environmentally, and mechanical measures are desired on site.

In view of the above-mentioned disadvantages, an object of the present invention is to provide, to drive an external pilot type proportional solenoid piston pump for driving an oil well pump, a hydraulic system that is able to avoid the occurrence of cavitation even when the control system stops while having a cost-efficient, simple structure not depending on electrical control.

Means for Solving the Problem

To achieve the above object, an oil-well-pump driving hydraulic system according to claim 1 includes: a bidirectional variable displacement piston pump that is rotated by an external driving source and displaces a variable element of a discharge rate by pilot control using an autogenous pressure of part of the pump discharge pressure against a spring force; a discharge rate detection portion that detects a discharge rate of the piston pump and outputs a corresponding detection signal; a discharge pressure detection portion that detects a discharge pressure of the piston pump and outputs a corresponding detection signal; a signal conditioning portion that outputs an output signal responsive to a difference between an external flow rate setting signal and the detection signal from the discharge rate detection portion or an output signal controlled responsive to a difference between an external pressure setting signal and the detection signal from the discharge pressure detection portion; a proportional solenoid control valve that controls a pump discharge rate by proportionally adjusting a communication opening between a pressure reception portion of the variable element and a pump discharge port in response to an input signal from the signal conditioning portion to control a displacement of the variable element; and an external pilot hydraulic circuit that introduces a discharge pressure from an external pump as a pilot control pressure. At least the bidirectional variable displacement piston pump, the discharge rate detection portion, the discharge pressure detection portion, and the proportional solenoid control valve are provided as a single unit structure in the same housing as the pump body. The pump body includes; a connection portion which is provided on the side surface of the housing and to which a pump discharge passage of the external pilot hydraulic circuit is connected; and a second pilot passage that introduces an external pilot pressure from the connection portion to a pilot passage between the discharge passage of the piston pump and the proportional solenoid control valve. Means that mechanically cuts off supply of the external pilot pressure when the discharge pressure of the piston pump is under a predetermined pressure is provided on the second pilot passage.

In the oil-well-pump driving hydraulic system according to claim 1, the means that cuts off the supply of the external pilot pressure in the oil-well-pump driving hydraulic system according to claim 2 includes a pilot operation check valve that uses part of the discharge pressure of the piston pump as a pilot pressure.

In the oil-well-pump driving hydraulic system according to claim 1 or 2, the discharge rate detection portion in the oil-well-pump driving hydraulic system according to claim 3 is a position sensor that detects a displacement of the variable element, and the discharge pressure detection portion is a pressure sensor that detects the pump discharge pressure.

Advantageous Effect of the Invention

In the oil-well-pump driving hydraulic system of the present invention, a method in which the piston pump waits in the unloaded state by mechanically cutting off the supplied pressure of the external pilot and returning to an autogenous pressure pump even when the controller stops for a certain reason and the load of the piston pump is lost is achieved as the compact and cost-effective structure containing the cut-off system in the pump body. Thus, there is an advantageous effect that simple piping and cost reduction can be achieved even in the external pilot hydraulic circuit.

PREFERRED EMBODIMENTS OF THE INVENTION

Figure 1:
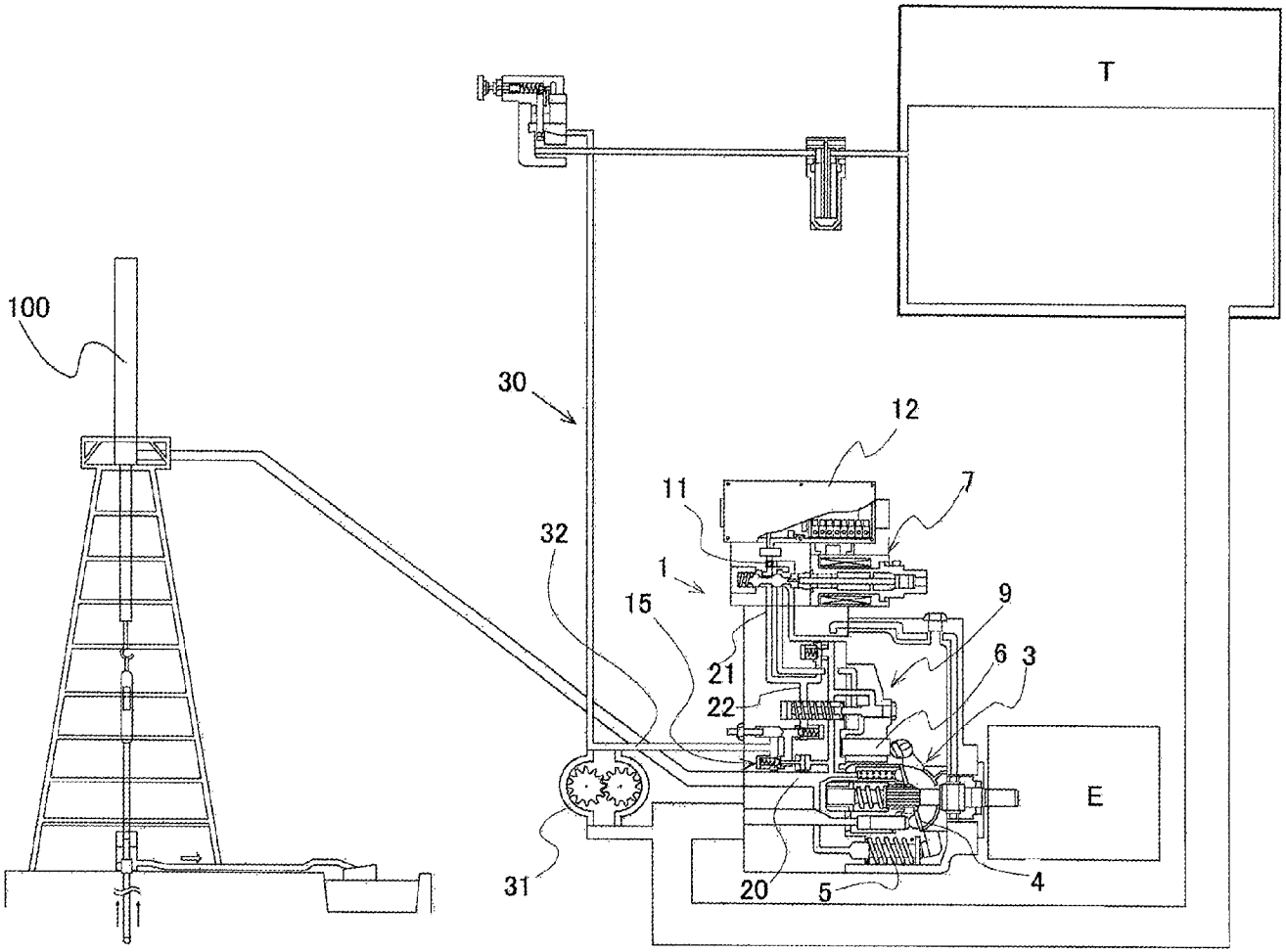
FIG. 1 is a partial cross section schematic view showing a schematic structure of an oil-well-pump driving hydraulic system of the present invention.

The present invention is an oil-well-pump driving hydraulic system including an external pilot type proportional solenoid bidirectional variable displacement piston pump, in which a pump body connected to an external pilot hydraulic circuit contains: a bidirectional variable displacement piston pump that executes pilot control to a displacement variable element by an autogenous pressure;

a discharge rate detection portion that detects a discharge rate of the pump and outputs a corresponding detection signal; a discharge pressure detection portion that detects a discharge pressure of the pump and outputs a corresponding detection signal; and a proportional solenoid control valve that proportionally displaces the variable element to control the pump discharge rate in response to an input signal from a signal conditioning portion that outputs an output signal responsive to a difference between an external flow rate setting signal and the detection signal from the discharge rate detection portion or an output signal controlled responsive to a difference between an external pressure setting signal and the detection signal from the discharge pressure detection portion; in the same housing integrally as a single unit. The pump body includes; a connection portion to which a pump discharge passage of the external pilot hydraulic circuit is connected; and a second pilot passage that introduces an external pilot pressure from the connection portion to a pilot passage between the discharge passage of the piston pump and the proportional solenoid control valve.

Additionally in the present invention, means that mechanically cuts off supply of the external pilot pressure when the discharge pressure of the piston pump becomes a predetermined pressure or below is further provided on the second pilot passage.

Therefore, according to the hydraulic system of the present invention, when the controller stops for a certain reason during the driving as the oil well pump and the load of the piston pump is generally absent, the cutoff means on the second pilot passage contained in the pump body mechanically cuts off the supply of the external pilot pressure and the piston pump itself can be unloaded in the wait state without depending on electric control. This cutoff means is the simplest when structured of a pilot operation check valve using part of the pump discharge pressure as the pilot pressure.

That is, when the variable element is an axial type piston pump having the swash plate, the risk of occurrence of cavitation caused by the swash plate pushed on the reverse side at the maximum angle is cancelled by mechanically cutting off the external pilot pressure in the compact and cost-effective structure even upon the cessation of the controller. Thus, even when left for a long period of time, the pump is prevented from being damaged. Further, as the external pilot hydraulic circuit, special equipment such as large suction piping and a prefill valve that causes the increase in cost and footprint is not necessary at all. Therefore, only a simple hydraulic circuit is necessary. Further, when a problematic place is restored, the hydraulic system of the present invention can be restarted satisfactorily because there is no damage in the piston pump.

It is noted that, in the hydraulic system of the present invention, the structure of the pump body other than the cutoff means can use the common one to the conventional proportional solenoid bidirectional variable displacement piston pump. For example, the discharge rate detection portion is able to be structured of a position sensor that detects displacement of the variable elements. When the variable elements include the swash plate and the operation piston that controls a tilt angle of the swash plate against a spring force, a potentiometer and a differential transformer that detect a rotational angle of the swash plate shaft and a displacement (travel distance) of the operation piston as displacement of the variable elements can be mentioned. A general pressure sensor that detects a pump discharge pressure may be used as the discharge pressure detection portion.

A signal conditioning portion that outputs an input signal for control valve driving to the proportional solenoid control valve may be a conventional control amplifier mounted in the proportional solenoid control valve, and may be properly set as one contained in the pump body integrally or one attached to the pump body externally.

A general control example by the control amplifier and proportional solenoid control valve is as follows. First, a flow rate setting signal provided from the external controller and a detection signal from the discharge rate detection portion are input. An output signal (voltage or current) corresponding to a difference between both signals is applied to the solenoid of the proportional solenoid control valve. When the input signal to the solenoid is the maximum, the proportional solenoid control valve fully opens the communication passage between the pressure reception portion of the variable element, such as the compression chamber of the operation piston that controls the swash plate angle, and the tank. Then, the swash plate is released from the pushing force of the operation piston, and in the state of the maximum tilt angle set by the spring force, the discharge rate of the piston pump is set as the set maximum rate.

When the input signal (voltage or current) from the control amplifier decreases, the opening of the communication passage is reduced gradually in proportion to the input signal. The communication passage between the compression chamber of the operation piston and the pilot passage from the pump discharge passage starts to be opened gradually. Then, when the input signal is absent, the pilot pressure is introduced to the compression chamber of the operation piston. The operation piston is able to push the swash plate back into the full cutoff position against the spring force.

The pressure setting signal applied from the external control and the detection signal from the discharge pressure detection portion are also input to the control amplifier. When there is no difference between both signals, the output signal corresponding to the cutoff signal is applied to the solenoid of the proportional solenoid control valve. The proportional solenoid control valve sets the opening of the communication passage in response to the input signal to introduce the pilot pressure to the compression chamber of the operation piston and to accordingly place the swash plate in the cutoff state.

In the normal operation, even when the pilot autogenous pressure of the piston pump is reduced, the pilot pressure on the operation piston required to maintain a desired swash plate angle is ensured by the pilot pressure introduced from the external pilot hydraulic circuit connected to the pump body.

In addition, also in the hydraulic system of the present invention, as well as in the past proportional solenoid piston pump, it is desirable to have the structure in which the relief valve is placed on the passage communicating from the tank to the pressure reception portion of the variable element in parallel to the proportional solenoid valve. In this case, the relief valve is also provided in the same housing to be integrally contained in the pump body.

EXAMPLE

Figure 2:
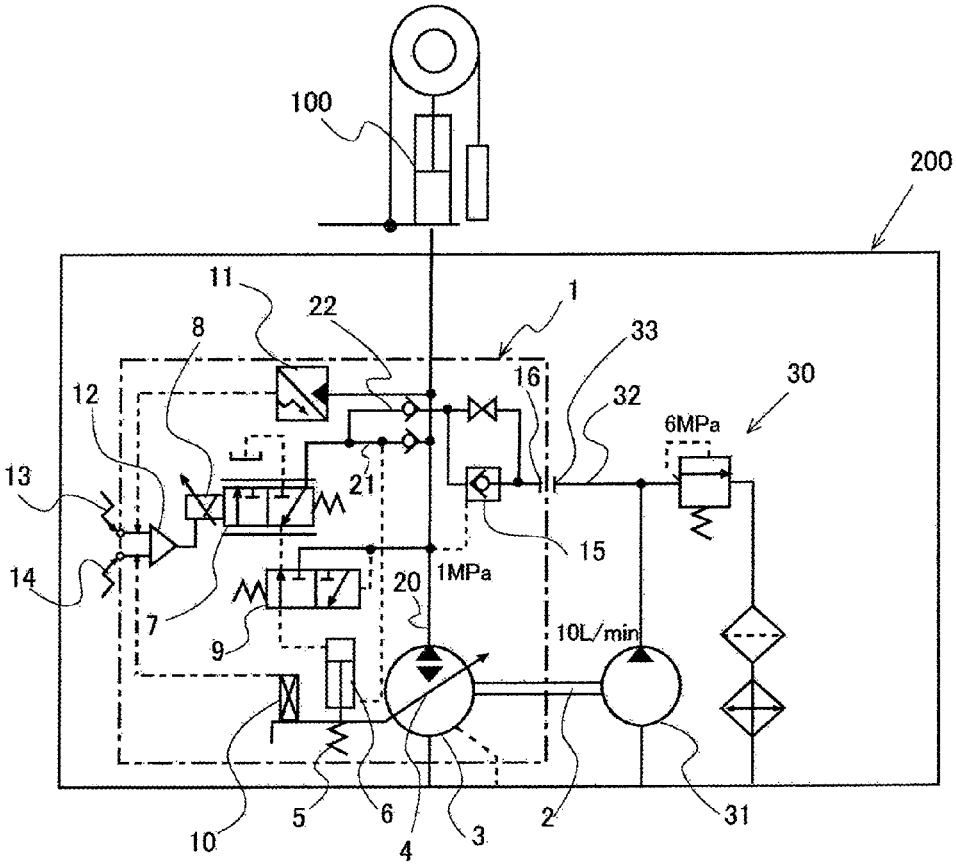
FIG. 2 is a schematic view of a hydraulic circuit of the hydraulic system of FIG. 1.
Figure 3:
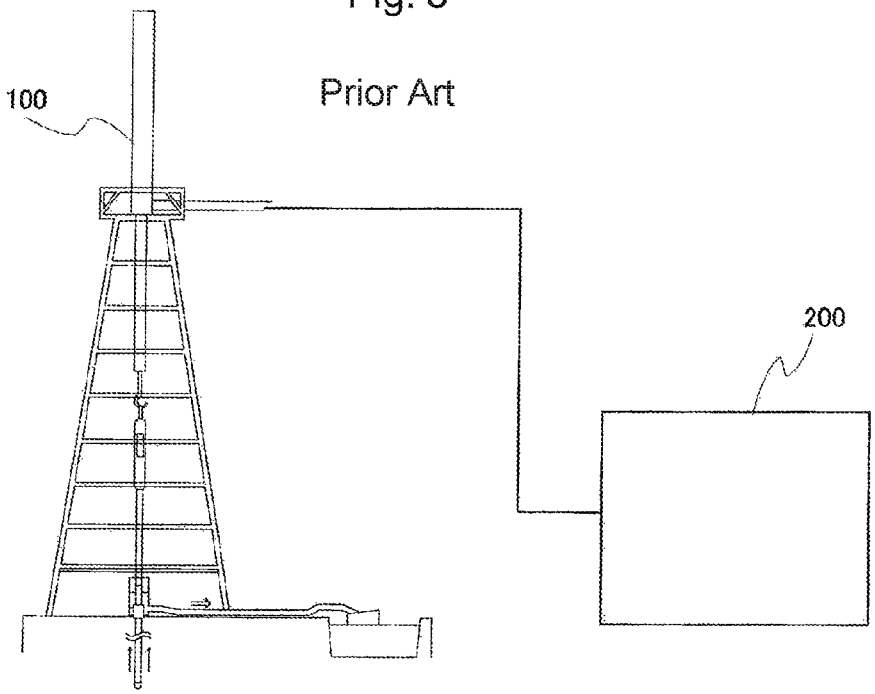
Fig. 3 Prior Art
FIG. 3 is a schematic view of a hydraulic cylinder type oil well pump.
Figure 4:
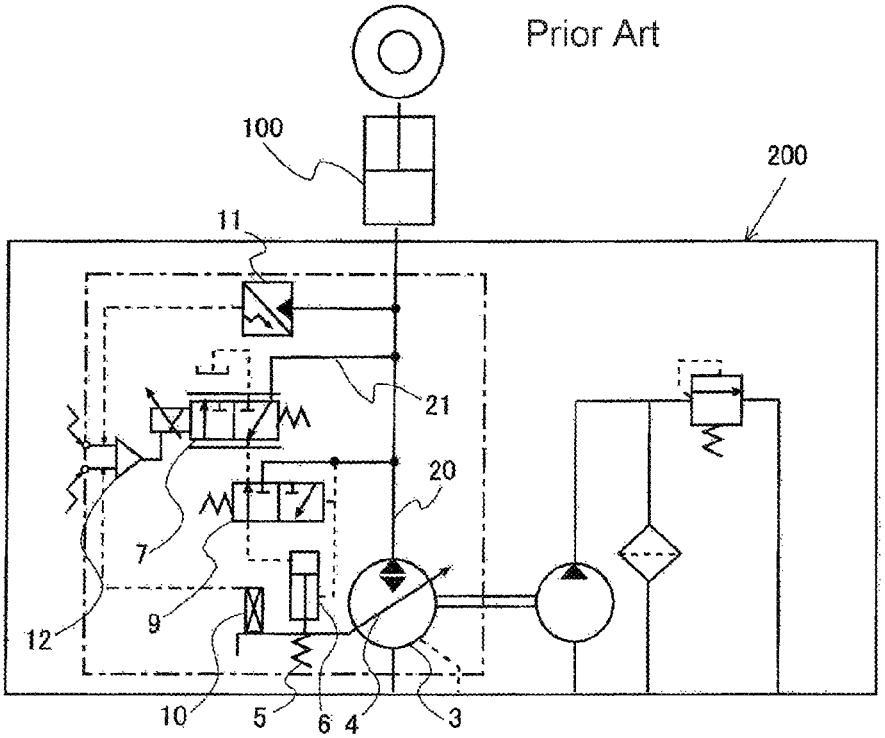
Fig. 4 Prior Art
FIG. 4 is a schematic view of a hydraulic circuit of an oil-well-pump driving hydraulic system mounting a conventional proportional solenoid bidirectional piston pump.
Figure 5:
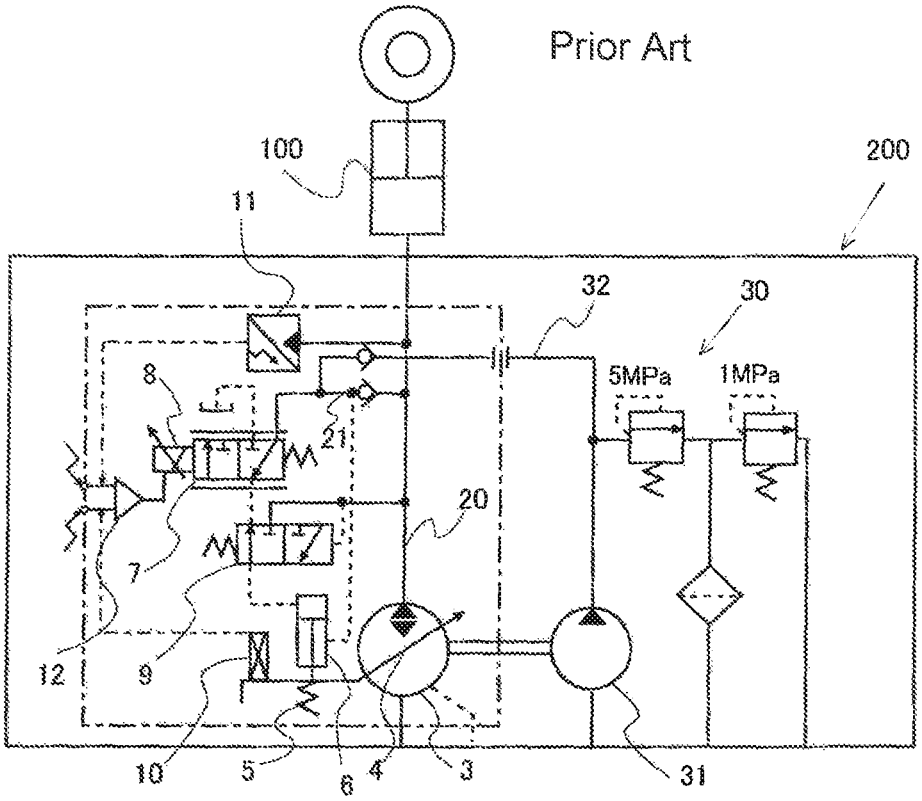
FIG. 5 is a schematic view of a hydraulic circuit of the oil-well-pump driving hydraulic system mounting the conventional external pilot type proportional solenoid bidirectional piston pump.
Figure 6:
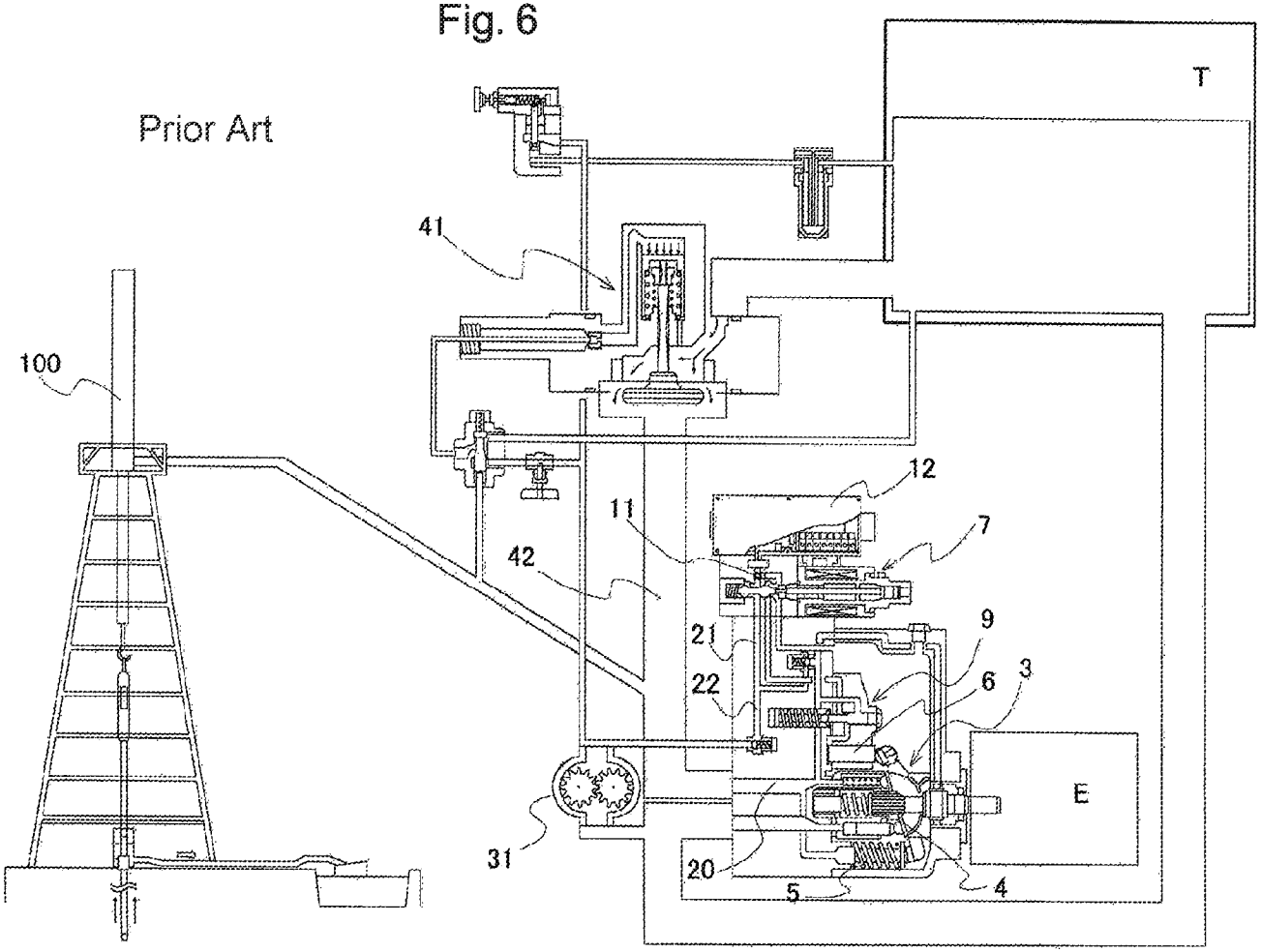
Fig. 6 Prior Art
FIG. 6 is a schematic partial cross section view showing the example in which equipment for preventing cavitation is provided in an external pilot hydraulic circuit as another conventional oil-well-pump driving hydraulic system.
Figure 7:
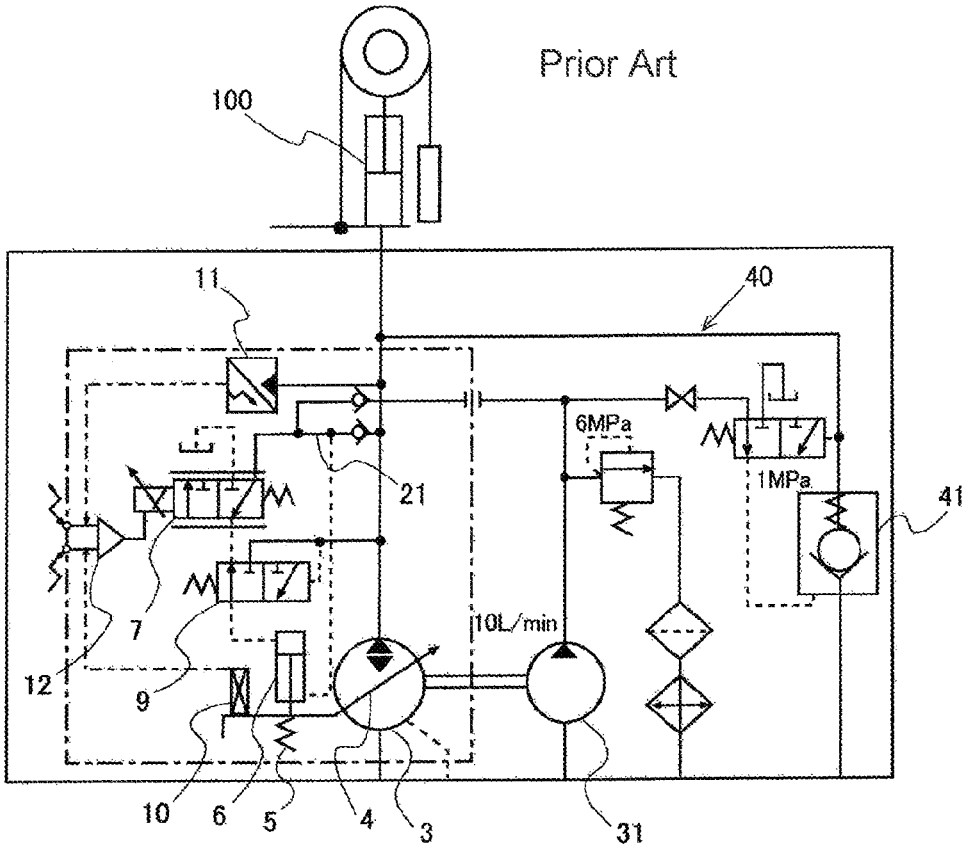
FIG. 7 is a schematic view of a hydraulic circuit of the hydraulic system of FIG. 6.
Figure 8:
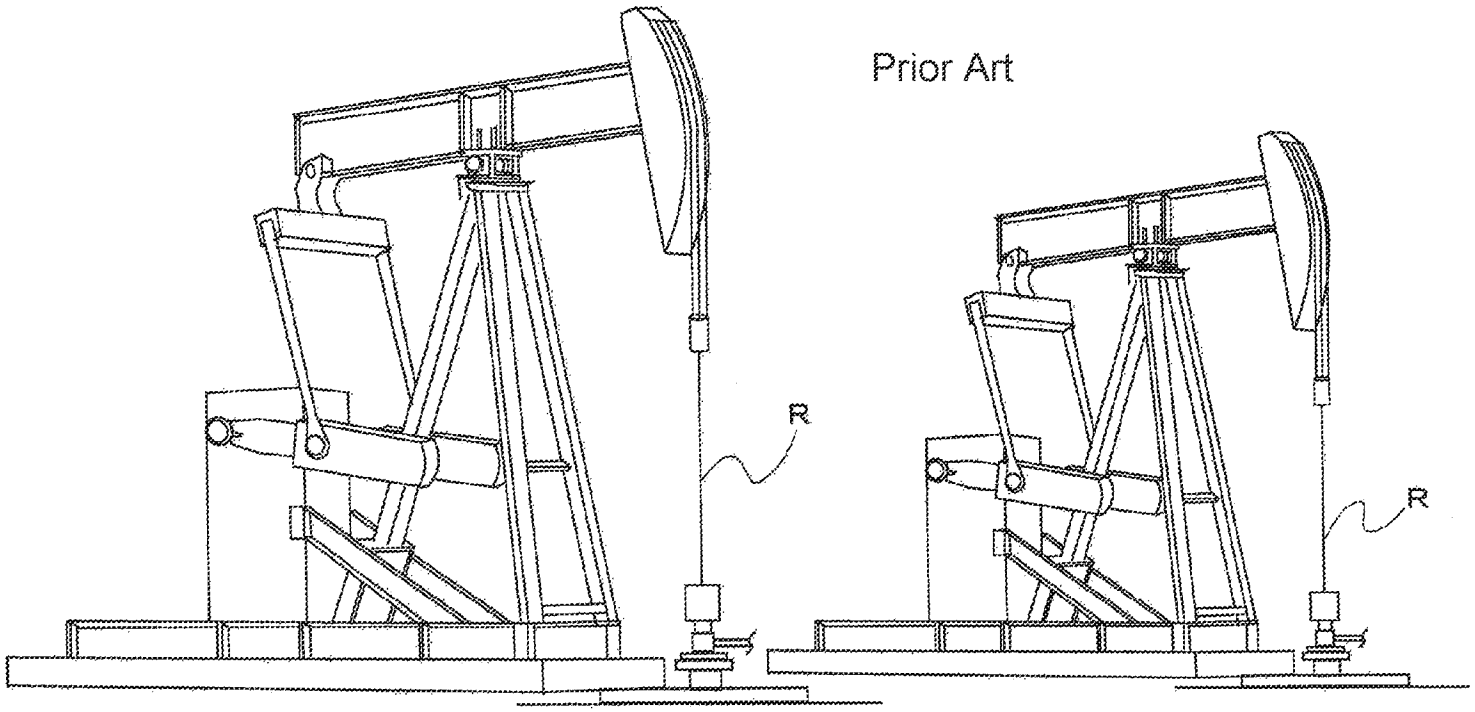
Prior Art Fig. 8
FIG. 8 is an outline view of a sucker rod pump as a conventional oil well pump.

A structure of an oil-well-pump driving hydraulic system as one example of the present invention is shown in a schematic cross section view of FIG. 1 and a schematic view of a hydraulic circuit of FIG. 2. The hydraulic system of this embodiment includes a pump body 1 that supplies hydraulic fluid to a hydraulic cylinder 100, which is a drive portion of the oil well pump, and an external pilot hydraulic circuit 30 connected to the pump body 1. In this embodiment, as a pump component in the pump body 1, an axial type bidirectional variable displacement piston pump is provided to control a discharge rate in response to an angle of a swash plate.

The pump body 1 has a compact form in which components are assembled as a single unit structure in the same housing, and is connected to the external pilot hydraulic circuit 30 at a connection portion 16 formed in the side surface of the housing.

Namely, the pump body 1 integrally contains: a bidirectional variable displacement piston pump 3 driven by a drive shaft of an external driving source (prime mover E); a swash plate 4 and an operation piston 6 as variable elements that are displaced by a pilot pressure against a spring 5 to control a discharge rate of the piston pump 3; a proportional solenoid control valve 7; a relief valve 9; a displacement detector 10 as a discharge rate detection portion that detects a displacement of the operation piston 6; a pressure sensor 11 that detects a pump discharge pressure; and a control amplifier 12 connected to a solenoid 8 of the proportional solenoid control valve 7.

The external pilot hydraulic circuit 30 has a fixed displacement pump 31 driven by a drive shaft 2 driven by the same driving source as the piston pump 3 and an external pilot passage 32 from a discharge port of the pump 31 to a connection portion 33 for the pump body 1.

From a discharge passage 20 from the discharge port of the piston pump 3 to the hydraulic cylinder 100, a pilot passage 21 for supplying a pilot pressure to a compression chamber of the operation piston 6 as a variable element pressure reception portion branches via the proportional solenoid valve 7 and relief valve 9. Further, between from the connection portion 16 to this pilot passage 21, a second pilot passage 22 that introduces the external pilot pressure is provided. Therefore, by the connection between the connection portion 16 for the pump body 1 and the connection portion 33 for the external pilot hydraulic pressure channel 30, the external pilot passage 32 communicates with the second pilot passage 22, and the discharge pressure from the external fixed displacement pump 31 can be introduced into the pilot passage 21 in the pump body 1 as the external pilot pressure.

For example, when an output signal corresponding to a flow rate setting signal 14 initially inputted from the external control is applied from the control amplifier 12 to the solenoid 8 of the proportional solenoid control valve 7 as an input signal (voltage or current), a communication portion between the compression chamber of the operation piston 6 and a tank is opened at an opening in proportion to the input signal, pressure fluid drops to a tank line, and the pressure to push the swash plate 4 onto the operation piston 6 decreases. Accordingly, with the positional displacement of the operation piston 6, the swash plate 4 tilts toward the angle corresponding to the set flow rate by the biasing force of the spring 5. Consequently, when the detection signal from the displacement detector 10 also changes and the state in which a difference between the detection signal and flow rate setting signal 14 is canceled is reached, the input signal from the control amplifier 12 becomes equivalent to zero, the proportional solenoid control valve 7 closes the communication portion between the pilot passage 21 and the compression chamber of the operation piston 6, the angle of the swash plate is maintained in that state, and the piston pump 3 discharges and supplies pressure fluid to the hydraulic cylinder 100 at the set flow rate.

Then, the piston rod advances by the supplied pressure fluid in the hydraulic cylinder 100, and when the piston rod reaches its stroke end, the piston rod stops. After that, the discharge pressure increases, and the detection value in the pressure sensor 11 also increases. Then, when the discharge pressure reaches an set discharge pressure and a difference between a pressure setting signal 13 and the detection signal becomes zero, the control amplifier 12 applies the input signal corresponding to a cutoff signal to the solenoid 8, and the proportional solenoid control valve 7 opens the communication portion between the pilot passage 21 and the compression chamber of the operation piston 6 to introduce the pilot pressure to the compression chamber of the operation piston 6. The operation piston 6 is displaced in response to the pilot pressure, and pushes the swash plate 4 into a full cutoff state against the biasing force of the spring 5 to decrease the pump discharge rate to substantially zero.

Further, even when the pilot pressure to the operation piston 6 required to maintain the full cutoff state is not sufficiently obtained from part of the discharge pressure of the piston pump 3, the discharge pressure of another pump 31 is able to be introduced from the external pilot hydraulic circuit 30 connected to the pump body 1 to the pilot passage 21 via the second pilot passage 22 as the pilot pressure.

Additionally, in the hydraulic system of this embodiment, a pilot operation check valve 15 that uses part of the discharge pressure of the piston pump 1 as the pilot pressure is placed on the second pilot passage 22. This valve cuts off the second pilot passage 22 to stop the supply of the pilot pressure from the external pilot hydraulic circuit 30 when the load pressure of the piston pump 3 is lost such as when the controller stops for some reason.

Therefore, there is no risk that the maximum angle state on the reverse side of the swash plate is fixed by excess introduction of continuous supply of the external pilot pressure into the compression chamber of the operation piston 6. Even when left for a long period of time, the pump does not continue drawing in the pressure fluid to cause any cavitation and damage of the pump, and can be unloaded in the wait state.

Thus, according to the hydraulic system of this example, it is not necessary to provide the extraordinarily large scale equipment for avoiding cavitation in the external pilot hydraulic circuit, and even in the compact and cost-efficient structure that contains the pilot operation check valve on the second pilot passage of the pump body, the maintenance of the piston pump can be achieved in the operation environment for driving the oil well pump where its site is left for a long period of time even when the controller stops. Therefore, when a problematic place is restored, this hydraulic system can be restarted without any problem.

DESCRIPTION OF REFERENCE NUMERALS

1 . . . Pump body
2 . . . Drive shaft
3 . . . Bidirectional variable displacement piston pump
4 . . . Swash plate
5 . . . Spring
6 . . . Operation piston
7 . . . Proportional solenoid control valve
8 . . . Solenoid
9 . . . Relief valve
10 . . . Displacement detector
11 . . . Pressure sensor
12 . . . Control amplifier
13 . . . Pressure setting signal
14 . . . Flow rate setting signal
15 . . . Pilot operation check valve
16 . . . Connection portion (for pump Body)
20 . . . Discharge passage
21 . . . Pilot passage
22 . . . second pilot passage
30 . . . External pilot hydraulic circuit
31 . . . Fixed displacement pump
32 . . . External pilot passage
33 . . . Connection portion (for external pilot hydraulic circuit)
40 . . . External hydraulic circuit
41 . . . Prefill Valve
42 . . . Suction piping
100 . . . Hydraulic cylinder
200 . . . Hydraulic system
T . . . tank
E . . . Prime mover
R . . . Sucker rod

The invention claimed is:

1. An oil-well-pump driving hydraulic system comprising:

a bidirectional variable displacement piston pump that is rotationally driven by an external driving source and that displaces variable elements to control a discharge rate by pilot control using an autogenous pressure of part of a discharge pressure of the pump against a spring force to make the discharge rate variable;

a discharge rate detection portion that detects the discharge rate of the piston pump and outputs a corresponding detection signal;

a discharge pressure detection portion that detects the discharge pressure of the piston pump and outputs a corresponding detection signal;

a control amplifier that outputs an output signal responsive to a difference between an external flow rate setting signal and the detection signal from the discharge rate detection portion or an output signal controlled responsive to a difference between an external pressure setting signal and the detection signal from the discharge pressure detection portion;

a proportional solenoid control valve that controls a pump discharge rate by proportionally adjusting an opening of a communication portion between a pressure reception portion of one of the variable elements and a pump discharge port in response to an input signal from the control amplifier to control a displacement of the one of the variable elements; and an external pilot hydraulic circuit that introduces a discharge pressure from an external pump as a pilot control pressure, wherein at least the bidirectional variable displacement piston pump, the discharge rate detection portion, the discharge pressure detection portion, and the proportional solenoid control valve are provided as a single unit structure in a same housing as a pump body, wherein the pump body includes:

a connection portion which is provided on a side surface of the housing and to which a pump discharge passage of the external pilot hydraulic circuit is connected; and a second pilot passage that introduces an external pilot pressure from the connection portion to a pilot passage between the discharge passage of the piston pump and the proportional solenoid control valve, and wherein a pilot operation check valve that mechanically cuts off supply of the external pilot pressure when the discharge pressure of the piston pump is under a predetermined pressure is provided on the second pilot passage, the pilot operation check valve using part of the discharge pressure of the piston pump as a pilot pressure.

2. The oil-well-pump driving hydraulic system according to claim 1, wherein the discharge rate detection portion comprises a position sensor that detects a displacement of the variable elements, and the discharge pressure detection portion comprises a pressure sensor that detects a pump discharge pressure.

* * * * *